US007692369B2

(12) United States Patent
Morimoto et al.

(10) Patent No.: US 7,692,369 B2
(45) Date of Patent: Apr. 6, 2010

(54) OPERATING UNIT AND LAMP WITH COMPONENT ALIGNMENT FOR SAFE FAILURE MODE

(75) Inventors: Etsuji Morimoto, Osaka (JP); Kazuhiko Itou, Osaka (JP); Shougo Takahashi, Kyoto (JP)

(73) Assignee: Panasonic Corporation, Osaka (JP)

( * ) Notice: Subject to any disclaimer, the term of this patent is extended or adjusted under 35 U.S.C. 154(b) by 472 days.

(21) Appl. No.: 11/577,699

(22) PCT Filed: Mar. 2, 2006

(86) PCT No.: PCT/JP2006/003946

§ 371 (c)(1),
(2), (4) Date: Apr. 20, 2007

(87) PCT Pub. No.: WO2006/093216

PCT Pub. Date: Sep. 8, 2006

(65) Prior Publication Data

US 2009/0066253 A1 Mar. 12, 2009

(30) Foreign Application Priority Data

Mar. 2, 2005 (JP) ..... 2005-058224
Mar. 1, 2006 (JP) ..... 2006-054769

(51) Int. Cl.
*H01J 1/02* (2006.01)
*F21V 29/00* (2006.01)

(52) U.S. Cl. ..... 313/46; 313/47; 313/27; 313/25; 313/11; 362/294; 362/257; 362/362; 362/377

(58) Field of Classification Search ..... 315/247, 315/246, 224, 225, 209 R, 274–289, 291–311; 313/324, 326, 355, 352, 27, 25, 26, 17, 11, 313/47, 46; 362/294, 257, 362, 377, 181
See application file for complete search history.

(56) References Cited

U.S. PATENT DOCUMENTS

| | | | | |
|---|---|---|---|---|
| 5,726,537 | A * | 3/1998 | Huber et al. | 315/311 |
| 5,925,984 | A * | 7/1999 | Fischer et al. | |
| 6,051,940 | A * | 4/2000 | Arun | 315/307 |
| 6,134,132 | A * | 10/2000 | Janssen et al. | |
| 6,252,357 | B1 * | 6/2001 | Tanaka et al. | |
| 6,784,624 | B2 * | 8/2004 | Buonocunto | 315/247 |
| 7,042,168 | B2 * | 5/2006 | Kitagawa et al. | |
| 2003/0025466 | A1 * | 2/2003 | Ludorf | 315/291 |
| 2005/0116663 | A1 * | 6/2005 | Van Casteren | 315/291 |
| 2005/0168166 | A1 * | 8/2005 | Yu et al. | 315/244 |

FOREIGN PATENT DOCUMENTS

JP 52-9855 * 1/1977

(Continued)

*Primary Examiner*—Tuyet Vo

(57) ABSTRACT

Discoloration and deformation of a resin case triggered by heat generation from a failed circuit component at the end of the life of an arc tube are prevented without increasing the cost and size. A lighting unit that lights a light source with an inverter while receiving electric power from an AC power supply, and that contains a lighting circuit that includes a plurality of circuit components inclusive of capacitors. Among the capacitors, all capacitors with an applied voltage of 50V or greater (C4, C5, C6, C7, C8, CD1 and CD2) are foil type film capacitors with exceptions of smoothing electrolytic capacitors (CD1 and CD2).

7 Claims, 9 Drawing Sheets

FOREIGN PATENT DOCUMENTS

| | | | |
|---|---|---|---|
| JP | 1-318223 | * | 12/1989 |
| JP | 9-190891 | * | 7/1997 |
| JP | 10-189279 | * | 7/1998 |
| JP | 11-289776 | * | 10/1999 |
| JP | 2000-82303 | * | 3/2000 |
| JP | 2002-015891 | * | 1/2002 |
| JP | 2002-043083 | * | 2/2002 |
| JP | 2002-134289 | * | 5/2002 |
| JP | 2002-516824 | * | 7/2002 |
| JP | 2003-100103 | * | 4/2003 |
| JP | 2004-303619 | * | 10/2004 |

* cited by examiner

FIG.4

| CAPACITOR | | SURFACE TEMPERATURE OF CAPACITOR | | CIRCUIT OPERATION | LAMP |
|---|---|---|---|---|---|
| | | NORMAL CAPACITOR | FAILED CAPACITOR | | |
| FOIL TYPE | C5 | 100℃ | AMBIENT TEMPERATURE | TERMINATED | OFF |
| | C8 | 100℃ | AMBIENT TEMPERATURE | TERMINATED | OFF |
| | C6 | 110℃ | 75℃ | PREHEATED | OFF |
| EVAPORATED FILM | C5,C8 | 100℃ | OVER 400℃ | THERMAL FUSE MELTDOWN | OFF |

OPERATING UNIT AND LAMP WITH COMPONENT ALIGNMENT FOR SAFE FAILURE MODE

TECHNICAL FIELD

The present invention relates to a lighting unit for a lamp and to a lamp including the lighting unit. More specifically, the present invention relates to a lighting unit and a lamp that are operated with an inverter.

BACKGROUND ART

With the recent trend of energy conservation, a low-pressure mercury discharge lamp has been increasingly used in the field of illumination. The low-pressure mercury discharge lamp, represented herein by a compact fluorescent light bulb, has a higher lamp efficiency and longer rated life than an incandescent light bulb does.

The compact fluorescent light bulb is generally comprised of an arc tube, a lighting unit for lighting the arc tube with an inverter, and a resin case for holding the arc tube and storing the lighting unit (see Patent Reference 1 for examples).

[Patent Reference 1] Japanese Laid-Open Patent Application No. 11-289776

DISCLOSURE OF THE INVENTION

The Problems the Invention is Going to Solve

When the arc tube is at the end of life, an emission mix applied to electrodes runs out. Due to this and other phenomena, there develops a difficulty in lighting the arc tube, causing the arc tube to flicker and flash. In such an occurrence, a circuit of the lighting unit functions differently from how it works during its normal state. In other words, the circuit of the lighting unit behaves in an abnormal manner, repeating an operation for initiating the light for a long time. Here, an overcurrent and an overvoltage cause circuit components that comprise the lighting unit to fail and generate heat. The heat may discolor, or worse deform the resin case.

The above difficulty may be caused not only by the end-of-life condition of the arc tube, but also by the abnormally heated circuit components resulting from the end-of-life condition and an early failure of the circuit components.

One of the solutions to avoid such a drawback is to include a thermal fuse in the lighting unit. However, considering that an operation speed of the thermal fuse is relatively slow, the discoloration and deformation of the resin case may be unavoidable when, for example, a distance between the heated circuit components and the resin case is close. Such a case is likely to happen particularly in recent years, when there is a tendency to downsize the resin case, let alone the lamp. Adding more thermal fuses to the lighting unit goes against demands for cost reduction and product downsizing, and thus is not a preferable solution.

The same problem applies to lamps other than the low-pressure mercury discharge lamp, such as an LED lamp, a halogen lamp and an HID lamp.

Given the above problem, the present invention aims to provide a lighting unit and a lamp that prevent discoloration and deformation of a resin case without increasing cost and size.

Means to Solve the Problems

In order to achieve the above aim, the present invention is a lighting unit that lights a light source with an inverter while receiving electric power from an AC power supply, and that contains a lighting circuit that includes a plurality of circuit components inclusive of capacitors, wherein, among the capacitors, all capacitors with an applied voltage of 50V or greater are foil type film capacitors with an exception of a smoothing electrolytic capacitor.

EFFECTS OF THE INVENTION

Focusing on the fact that failure modes of the circuit components take a wide variety of forms depending on type and use of the circuit components, inventors of the present invention (hereinafter referred to as inventors) researched and examined the failure modes of the circuit components used for the lighting unit. A result of the research and examination shows that, among the circuit components used for the lighting unit, capacitors are relatively failure prone. Such failure-prone circuit components require careful handling, especially when heated during the failure. The inventors further researched the heat generated during the failure among various types of capacitors. As a result, it is found that the foil type film capacitors are hardly heated when failed. This is presumably because the foil type film capacitors fail in a complete short circuit mode. With this complete short circuit mode, the capacitors do not generate heat, even when carrying the overcurrent due to the failure. Such a construction can prevent the discoloration and deformation of the resin case.

In the above construction, the capacitors used in the lighting unit are the foil type film capacitors. The above construction does not add more circuit components to the lighting unit.

The above construction thereby prevents the discoloration and deformation of the resin case without increasing cost and size.

In addition to the foil type film capacitors, the inventors also conducted a research on a heat generation pertaining to a failure of evaporated film capacitors. The research has found, however, that the failed evaporated film capacitors generate an abnormal heat. This is presumably because when the evaporated film capacitors are used in the lighting unit, the failure mode thereof has an unstable resistance to become neither the complete short circuit mode nor a complete open circuit mode. Such a resistant nature causes the capacitors to generate heat when carrying the overcurrent due to the failure.

The smoothing electrolytic capacitor is excluded from the above construction, as it is assumed that the smoothing electrolytic capacitor cannot cause the discoloration and deformation of the resin case. When in failure, an electrolytic capacitor immediately ceases to function. In other words, once the electrolytic capacitor fails, an electric current will not travel through the electrolytic capacitor for a long time. As a result, the failed electrolytic capacitor remains unheated, and thus does not cause the discoloration and deformation of the resin case.

Moreover, according to the above construction, capacitors applied with a relatively low voltage of less than 50 V do not need to be the foil type film capacitors. This is presumably because the capacitors with an applied voltage of less than 50 V do not receive much flow of electric current, even if the failure mode of the capacitors has an unstable resistance value. It is thereby assumed that such capacitors do not cause the discoloration and deformation of the resin case.

The above construction also prevents the discoloration and deformation of the resin case triggered by the failed capacitors. The above construction further prevents the discoloration and deformation of the resin case and resin parts caused by: (i) any failure, end-of-life condition, and defective components of the lighting unit; (ii) misusage of the lighting unit; and (iii) failure of the lighting unit when used in an abnormal place.

The above aim is also achieved by a lighting unit that lights a light source with an inverter while receiving electric power from an AC power supply, and that contains a lighting circuit that includes a plurality of circuit components inclusive of capacitors, wherein, among the capacitors, all capacitors with an applied voltage of 50V or greater are foil type film capacitors with exceptions of a smoothing electrolytic capacitor and a ceramic snubber capacitor.

The ceramic snubber capacitor is excluded from the above construction, for it is assumed that the ceramic snubber capacitor cannot cause the discoloration and deformation of the resin case. Because the ceramic snubber capacitor fails in the complete open circuit mode, the electric current does not flow through the failed ceramic snubber capacitor. As a result, the ceramic snubber capacitor remains unheated, and thus does not cause the discoloration and deformation of the resin case.

With the ceramic snubber capacitor having the complete open circuit mode, the lighting unit can continue to carry on the lighting operation, although there is a slight increase in the loss of electric power at a switch element. That is to say, the end-of-life snubber capacitor does not affect the life duration of the lighting unit.

In the foil type film capacitors, electrodes may be each connected to a lead by welding.

When the electrodes and the leads are welded together as previously described, the welded areas that connect the electrodes and the leads do not suffer from the problem of loose connection, even after the foil type film capacitors fail. This prevents the heat triggered by the loose connection. Also by having the electrodes and the leads that are welded together, the shorted-out foil type film capacitors can receive quite an amount of electric current and remain shorted out without being heated, no matter how large the electric current is. Such foil type film capacitors thereby are safe and can be used in various kinds of places.

The lighting circuit may include: a current fuse element inserted in series into a path connecting between the AC power supply and a rectifier smoothing circuit; and a noise suppression capacitor connected in parallel to the rectifier smoothing circuit between the current fuse element and the rectifier smoothing circuit.

Using the foil type film capacitor as the noise suppression capacitor as previously described has the following advantages.

(a) The resin case cannot be discolored or deformed, even after the noise suppression capacitor fails. The reason has been stated above.

(b) As the foil type film capacitor fails in the complete short circuit mode, the moment the noise suppression capacitor fails, a large electric current flows through the foil type film capacitor. This immediately melts the current fuse element, terminating the lighting operation on the spot.

(c) Withstand voltage and temperature of the foil type film capacitor are inversely proportional to each other. Therefore, when an ambient temperature around the lighting unit is high, it is possible to preferentially cause the foil type capacitor to fail before other circuit components do. As a result, the lighting unit is protected.

(d) When in failure, the foil type film capacitor allows a large electric current, but does not allow an unstable, weak electric current, to flow through itself. Hence, the current fuse element may have a wide dispersion infusing characteristics when subjected to a weak electric current. For example, the current fuse element may be a wirewound, fusing resistor (with a power rating of about ½-1 W) that has a wide dispersion in fusing characteristics when receiving an electric current of 1 A or so. It is also permissible to use a regular wirewound resistor as the current fuse element.

The lighting circuit may include: a current fuse element inserted in series into a path connecting between the AC power supply and a rectifier smoothing circuit; and a noise suppression capacitor connected in parallel to an output path of the rectifier smoothing circuit.

In the above construction, the noise suppression capacitor is placed in an output path of the rectifier smoothing circuit. This configuration yields the following advantages.

(a) The noise suppression capacitor can be removed from an AC line. This can downsize an AC pattern that requires a large insulation distance, which is (i) for reducing noise on a printed circuit board and (ii) required by the Japanese Electrical Appliance and Material Safety Law. Subsequently, the printed circuit board as a whole can be downsized as well.

(b) Even when the lighting circuit is accidentally used together with a dimmer, a phase advancing current hardly runs through the dimmer. This results in reduction of dimmer malfunction, and prevention of an extreme increase in the electric current that is accidentally fed into the lighting circuit.

(c) In the case where the inverter circuit employs a half-bridge inverter, a pair of capacitors is connected in parallel to a pair of switch elements, while a filter coil is connected in series to the pair of switch elements. That is to say, the pair of capacitors, the electrolytic capacitor for the rectifier smoothing circuit, and the filter coil together construct a pi-shaped LC filter. This means, the pair of capacitors not only has an inherent capacitance coupling function, but also works as the noise suppression capacitor. The normally required noise suppression capacitor, which is provided at the AC power supply side, can be thus removed, leading to the downsizing of the lamp.

(d) As a rating capacity of the noise suppression capacitor can be set low, the lighting unit can be subsequently downsized.

The current fuse element may be a wirewound resistor.

With the above construction, the lighting unit can be generated at very low cost.

At least one of the foil type film capacitors may be formed in a U shape and arranged to cover at least part of other circuit components.

According to the above construction, when the other circuit components generate heat owing to the end-of-life condition thereof, it is possible to preferentially cause the foil type film capacitors to fail before the other circuit components do. The foil type film capacitors fail in the complete short circuit mode, and therefore can terminate the lighting operation safely without generating heat.

The above aim is further achieved by a lighting unit that lights a light source with an inverter while receiving electric power from an AC power supply, and that contains a lighting circuit that includes a plurality of circuit components inclusive of a current fuse element and a noise suppression capacitor, wherein (i) the current fuse element is inserted in series into a path connecting between the AC power supply and a rectifier smoothing circuit, (ii) the noise suppression capacitor is connected in parallel to an output path of the rectifier smoothing circuit, and (iii) the noise suppression capacitor is a foil type film capacitor.

In the above construction, the noise suppression capacitor is placed in the output path of the rectifier smoothing circuit. The resulting advantages have been described above.

The above aim is yet further achieved by a lighting unit that lights a light source with an inverter while receiving electric power from an AC power supply, and that contains a lighting circuit that includes a plurality of circuit components inclusive of capacitors, wherein among the capacitors which are not foil type film capacitors, one is connected in parallel to the foil type film capacitors.

According to the above construction, if a certain capacitor generates heat due to the end-of-life condition thereof, it is possible to preferentially cause the foil type film capacitors to fail before the certain heat-generating capacitor does. The foil type film capacitors fail in the complete short circuit mode, and therefore can terminate the lighting operation safely without generating heat.

Each of the foil type film capacitors may include a laminated sheet that is constructed with a first metal foil, a second metal foil, and a resin film that is sandwiched by the first metal foil and the second metal foil.

With the above construction, the lighting unit can be downsized and generated at low cost.

In order to achieve the above aim, the present invention also provides a lighting unit that lights a light source with an inverter while receiving electric power from an AC power supply, and that contains a lighting circuit that includes a plurality of circuit components inclusive of capacitors, wherein at least one of the capacitors is a foil type film capacitor that is formed in a U shape and arranged to cover at least part of other circuit components.

According to the above construction, when the other circuit components generate heat due to the end-of-life condition thereof, it is possible to preferentially cause the foil type film capacitors to fail before the other circuit components do. The foil type film capacitors fail in the complete short circuit mode, and therefore can terminate the lighting operation safely without generating heat.

In order to achieve the above aim, the present invention further provides a lamp comprising: a light source; a lighting unit that lights the light source with an inverter while receiving electric power from an AC power supply, and that contains a lighting circuit that includes a plurality of circuit components inclusive of capacitors; and a case for holding the light source and storing the lighting unit, wherein, among the capacitors, all capacitors with an applied voltage of 50V or greater are foil type film capacitors with an exception of a smoothing electrolytic capacitor.

When a lamp contains the lighting unit and the light source that are combined into one, the loss of the light source is so great that the circuit is heated to a high temperature, which is rarely seen in normal circuit components. This may possibly lead to frequent failure of the lamp and the discoloration and deformation of the resin case. However, the above construction can at least reduce the heat generation due to the failure of the circuit components, and safely prevents the discoloration and deformation of the resin case.

In order to achieve the above aim, the present invention yet further provides a lamp comprising: a light source; a lighting unit that lights the light source with an inverter while receiving electric power from an AC power supply, and that contains a lighting circuit that includes a plurality of circuit components inclusive of capacitors; and a case for holding the light source and storing the lighting unit, wherein, among the capacitors, all capacitors with an applied voltage of 50V or greater are foil type film capacitors with exceptions of a smoothing electrolytic capacitor and a ceramic snubber capacitor.

The above construction not only yields the previously mentioned advantages but also downsize the lamp.

The light source may be a low-pressure mercury discharge tube.

With the above construction, a lamp can be generated at low cost. Also, filaments in filament electrodes burn out, when the arc tube is at the end of life, or when the components of the lighting unit fail. As a result, a circuit oscillation is terminated. In other words, the above construction can terminate the circuit in an easiest and safest mode. Here, the following advantages are further obtained: (i) the time until the circuit termination (described above) can be adjusted by heating the filament electrodes; and (ii) the protective operation (described above) is further secured by increasing the circuit temperature to a predetermined one.

The low-pressure mercury discharge tube, from one end to the other thereof, may be formed into a double spiral.

With the above construction, the electrodes can be placed in close proximity to the printed circuit board. In this case, if the heat generated around the electrodes of the end-of-life arc tube increases, the circuit can be heated rapidly via the printed circuit board that has fast heat conductivity. This derives more distinguished, advantageous effects from the end-of-life foil type film capacitors, and further improves the safety of the lamp.

The lighting circuit may include two switch elements and two coupling capacitors, both of which (i) are connected in series to an output terminal of a rectifier smoothing circuit, and (ii) together constitute a half-bridge inverter circuit, and at least one of the two coupling capacitors is placed in an area that is the farthest from the light source stored in the case.

In the above implementation, the lamp is protected from abnormal heat which is generated by the lighting circuit and which ascends heightwise. When placed far from the arc tube, the two coupling capacitors have a lower operating temperature, and thus can be applied with thinner films for downsizing themselves, no matter how large a capacitance the coupling capacitors require.

BRIEF DESCRIPTION OF THE DRAWING

FIG. 4 shows an examination result of heat that is generated by each capacitor included in the lamp 1 of the present invention.

DESCRIPTION OF CHARACTERS

10 Arc tube
20 Holder
21 Resin Material
30 Resin Case
31 Bracket
40 Base
50 Lighting Unit
51 Printed Circuit Board
100 Rectifier Smoothing Circuit
110 Inverter Circuit
120 Resonant Circuit
130 Preheating Circuit

BEST MODE FOR CARRYING OUT THE INVENTION

The following describes a best mode for carrying out the present invention in detail with reference to the accompanying drawings.

1. Overall Structure of Lamp 1

Figure 1:
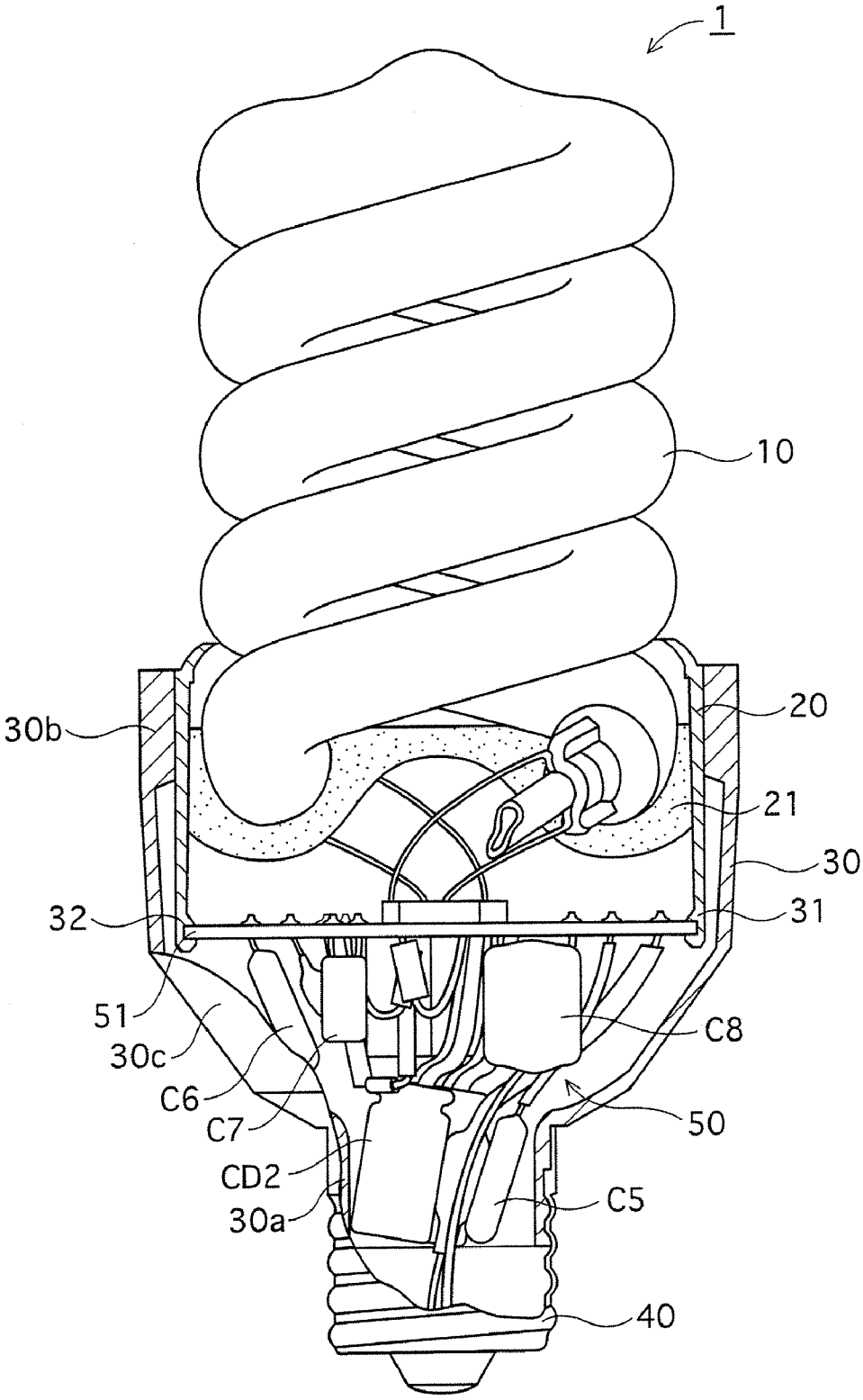
FIG. 1 is a side view of a lamp 1 of the present invention.

FIG. 1 is a side view of a lamp 1 of the present invention, wherein a part of the lamp 1 is cut out to make an inside of the lamp visible.

The lamp 1 contains: an arc tube 10 forming a double-spiral discharge path; a holder 20 for holding the arc tube 10; a lighting unit 50 for lighting the arc tube 10; and a resin case 30. The resin case 30 is attached to a base 40 at one end and houses the holder 20 and the lighting unit 50 therein.

Both ends of the arc tube 10 are each provided with an electrode attached with a filament coil.

Made of a resin material such as PET (polyethylene terephthalate), the holder 20 has an insertion hole whose shape conforms to electrode forming parts of the arc tube 10. The electrode forming parts of the arc tube 10 are inserted into the insertion hole of the holder 20. The arc tube 10 is secured in the holder 20 by a resin material 21 that is made of silicone resin and the like.

Made of PBT (polybutylene terephthalate) and such, the resin case 30 includes: a small diameter part 30*a*; a large diameter part 30*b* which is larger in diameter than the small diameter part 30*a*; and a taper part 30*c* that is placed between the small diameter part 30*a* and the large diameter part 30*b*, and is gradually and externally tapered from the small diameter part 30*a* toward the large diameter part 30*b*. In other words, the resin part 30 has a funnel shape.

Regarding the resin case 30, the holder 20 is fitted within the large diameter part 30*b*, whereas the base 40 is fitted around the small diameter part 30*a*. Although an outer surface of the holder 20 is adhered to the large diameter part 30*b* of the resin case 30 according to the previous description, the resin case and the holder may be combined into one.

That is to say, the resin case may be anything so long as the resin case (i) can store an arc tube, (ii) has a base fitted around a small diameter part thereof, and (iii) can store a lighting unit inside thereof. The resin case may have any number of components and any shape.

The base 40, for example, has a cylindrical metal body whose exterior surface has a carved groove. Although an E17 screw base is used herein as the base 40, the base 40 should not be limited to such, but may be an E26 screw base or a bayonet base.

The lighting unit 50 stored in the resin case 30 contains a printed circuit board 51, which is wired in a predetermined pattern on a main surface thereof, and which is populated with electronic components. With a rim of the circuit board 51 being held into place by brackets 31 and 32, the lighting unit 50 is installed within the resin case 30.

2. Overall Structure of Lighting Unit 50

Figure 2:
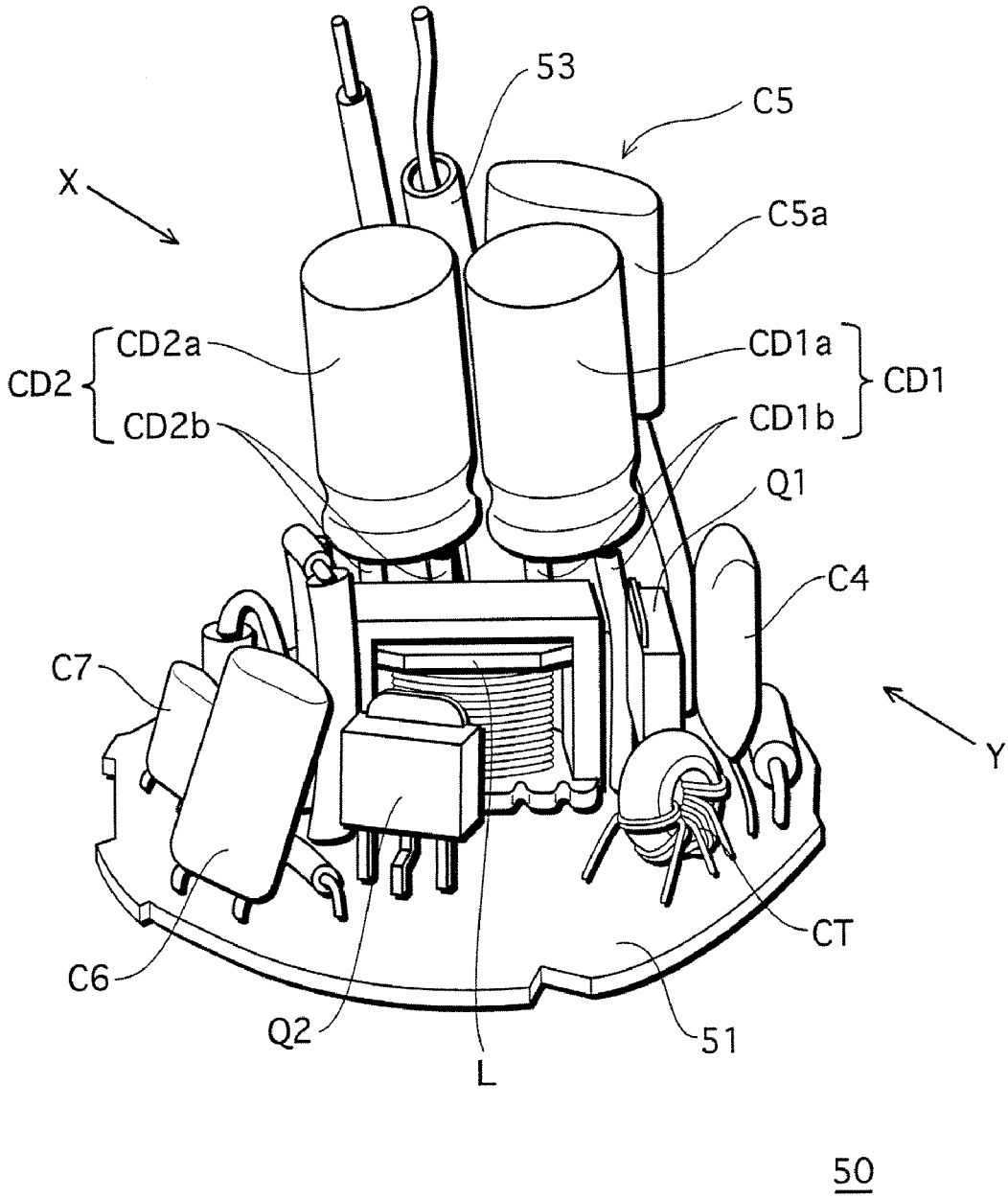
FIG. 2 is an external view of a lighting unit 50 of the present invention.

FIG. 2 is a perspective view showing an external appearance of the lighting unit 50 of the present invention.

The lighting unit 50 contains the printed circuit board 51, the main surface of which is populated with each circuit component. Shaped into an approximate circle, the printed circuit board 51 has a choke coil L mounted on a center thereof. Capacitors C4, C5 and C6 are placed along a periphery of the printed circuit board 51. Though hidden behind two electrolytic capacitors CD1 and CD2, other capacitors contained in the lighting unit 50 are also placed along the periphery of the printed circuit board 51.

3. Circuit Structure of Lamp 1

Figure 3:
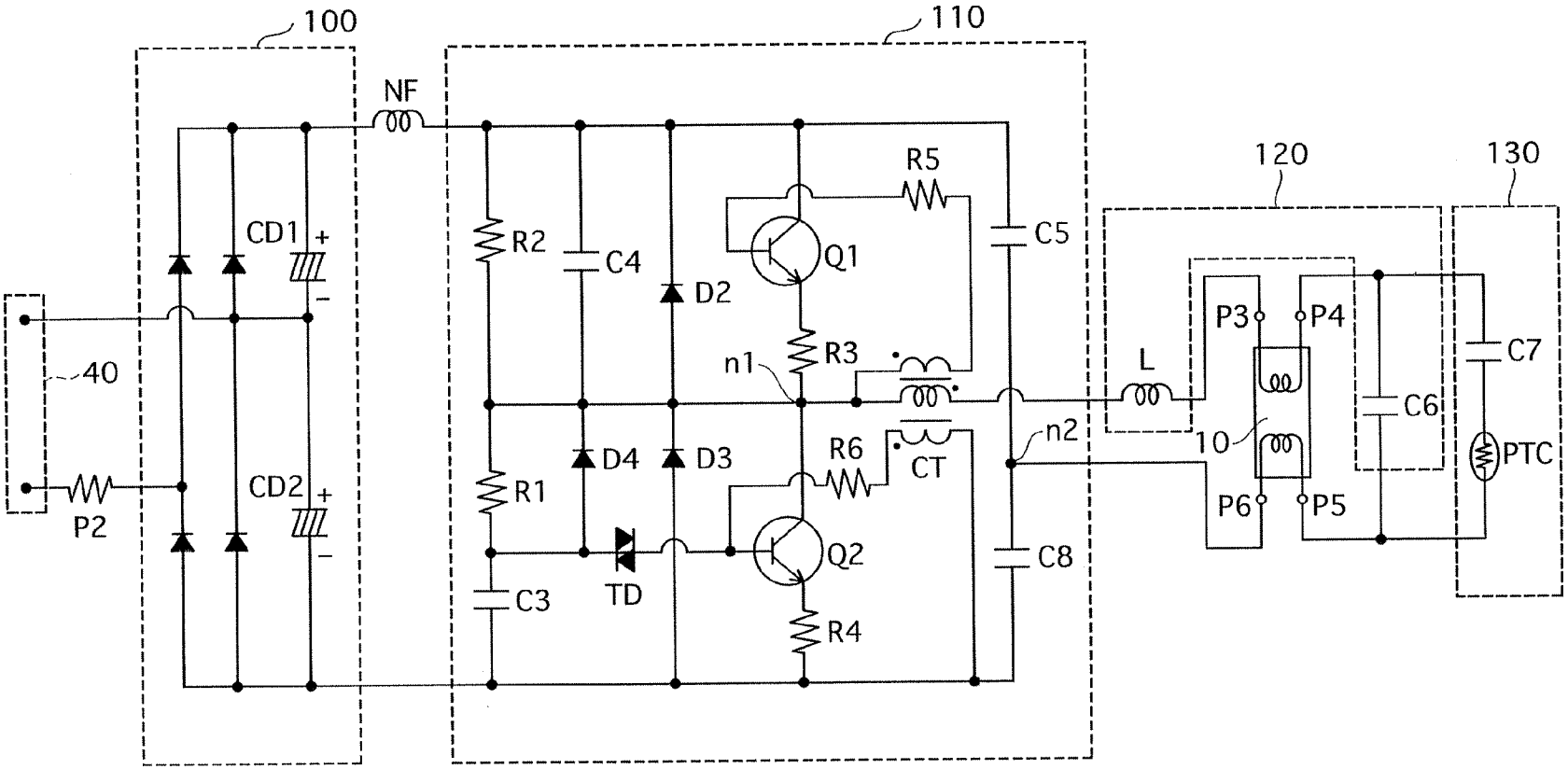
FIG. 3 shows a circuit structure of the lamp 1 including the lighting unit 50.

FIG. 3 is a diagram showing a circuit structure of the lamp 1 including the lighting unit 50.

The lighting unit 50 contains a lighting circuit. The lighting circuit mainly includes: a rectifier smoothing circuit 100; an inverter circuit 110; a resonant circuit 120; and a preheating circuit 130.

In order to output a direct current, the rectifier smoothing circuit 100 converts a commercially available low-frequency alternating current into the direct current by rectification and smoothing. The rectifier smoothing circuit 100 includes diode bridges and electrolytic capacitors. Being a voltage multiplier, the rectifier smoothing circuit 100 outputs a voltage that is about 2.8 times larger than that (in effective value) fed thereinto. For example, when receiving a voltage of 100 V (in effective value) from a commercial power supply, the rectifier smoothing circuit 100 outputs a voltage of about 280 V.

The lighting unit 50 is connected via the base 40 to the commercial power supply. A resistor P2 is inserted into a path connecting between the base 40 and the rectifier smoothing circuit 100. More specifically, the resistor P2 is connected to an input side of the rectifier smoothing circuit 100. The resistor P2 functions as an inrush current limiting resistor and a current fuse.

The inverter circuit 110 includes a half-bridge inverter, which is constructed by two switch elements (transistors Q1 and Q2) and two coupling capacitors (C5 and C8). The term "half-bridge inverter" herein only implies a bridge inverter that is constructed by two switch elements and two capacitors, and does not imply a deformed half-bridge inverter that is constructed by two switch elements and one capacitor. The inverter circuit 110 has a function of supplying high-frequency electricity (e.g., 50 kHz) to load circuits (i.e., the resonant circuit 120, the preheating circuit 130, and the arc tube 10).

The inverter circuit 110 obtains the stated function by having the transistors Q1 and Q2 that are switched on and off in alternative shifts. To achieve such a switching operation, a primary coil of a current transformer CT is connected in series to the load circuit, while two secondary coils are respectively connected to bases of the transistors Q1 and Q2.

A secondary coil induces a voltage in accordance with size and direction of a load current that has flowed through the primary coil. According to the structure shown in FIG. 3, the load current that travels through the transistor Q1 while the transistor Q1 is on induces the voltage to the secondary coil; turning off the transistor Q1 causes the transistor Q2 to be turned on. Meanwhile, the load current that travels through the transistor Q2 while the transistor Q2 is on also induces the voltage to the secondary coil; turning off the transistor Q2 causes the transistor Q1 to be turned on. This is how the above switching operation works.

Upon input of the electric power, a starting circuit (including resistors R1 and R2, a starting capacitor C3, and a trigger diode TD) conducts the switching operation. The resistors R1 and R2 and the starting capacitor C3 are connected in series. Anode connecting between the resistor R1 and the starting capacitor C3 is wired, via the trigger diode TD, to the base of the transistor Q2. When the electric power is fed into to the lighting unit 50, the voltage between terminals of the starting capacitor C3 increases at a certain time constant. This time constant is determined by a resistance value of the resistors R1 and R2 and a capacitance of the starting capacitor C3. When exceeding a breakover voltage of the trigger diode TD, the terminal voltage of the starting capacitor C3 is applied to the base of the transistor Q2. This action turns on the transistor Q2, starting the switching operation.

The inverter circuit 110 further includes a snubber capacitor C4. Once the switching operation starts, the voltage output from the current transformer CT causes the transistors Q1 and Q2 to repeat the alternative on-and-off status. Here, a turnoff movement of the switching operation requires a certain time, which is peculiar to the switch elements. In addition, the electric current that had flowed right before the turnoff movement also flows all the way through the choke coil L. This generates a time lag in the switching operation (i.e., some amount of electric power remains to flow, even when there is no voltage applied). As a result, there occurs a substantial increase in a loss of electric power at the transistors Q1 and Q2. To suppress such a loss due to the switching operation, the snubber capacitor C4 is installed for protecting the transistors Q1 and Q2.

The inverter circuit 110 is connected to the rectifier smoothing circuit 100 via a filter coil NF, which removes a switching noise generated by the transistors. Here, the filter coil NF, the coupling capacitors C5 and C8, and the electrolytic capacitors CD1 and CD2 construct a pi-shaped LC filter. This prevents the switching noise from flowing towards the commercial power supply, and also enhances an immunity of the switch element.

Connected in series to the choke coil L and a resonant capacitor C6, the resonant circuit 120 is operable to flow a preheating current to the filament coils in the initial stage of the lighting operation, and also to increase the voltage between the filament coils.

The preheating circuit 130, connected in parallel to the resonant capacitor C6, includes an auxiliary capacitor C7 for lowering a resonant frequency of the resonant circuit 120 in the initial stage of the lighting operation.

The inverter circuit 110, the resonant circuit 120 and the preheating circuit 130 include a plurality of capacitors as described above. In the present embodiment, these capacitors are regarded as the foil type film capacitors. The foil type film capacitors completely short out when in failure, thereby do not generate heat afterward even when the electric current runs inside thereof. The term "complete short circuit" herein indicates a resistance value of 2 ohms or less.

Furthermore, the foil type film capacitors adopted herein have metal foils (electrodes) and metal wires (leads) that are welded together. In this implementation, the welded areas that connect the electrodes and the leads do not suffer from the problem of loose connection when the foil type film capacitors fail, avoiding the heat triggered by such a loose connection. There is a case where thermal spray techniques are used for joining the electrodes to the leads of the foil type film capacitors. In this case, when the thermal-sprayed joints become loose, a resistance value of the foil type film capacitors increases by about 10 ohms. When each capacitor's layer structure (formed by foils and films) shorts out, a resistance value of the shorted structure is 2 ohms or less. That is to say, the foil type film capacitors generate heat when the thermal-sprayed joints become loose, but do not when each capacitor's layer structure shorts out. It should be noted here that even if the foil type film capacitors generate heat due to the loose joints, fusion of the foils and the thermal-sprayed areas eventually solves the problem of the loose joints. The heat, therefore, does not remain. A current capacity of the foil type film capacitors increases during the failure, especially when the foils and the leads are welded together. This effectively prevents the heat generation, even when various types of electric current run through the lighting unit.

It is assumed here that a rated temperature of each capacitor is 125° C. A rated voltage of each capacitor is assumed as follows: (i) the coupling capacitors C5 and C8: 250 V; (ii) the resonant capacitor C6: 1.2 kV; (iii) the snubber capacitor C4: 1.2 kV; (iv) the auxiliary capacitor C7: 1.2 kV; (v) the starting capacitor C3: 100 V. The foil type film capacitors are each constructed by rolling a layer of the metal foils (electrodes) and a dielectric films (dielectrics) that alternately overlap one another. Thickness of the dielectric films depends on material and withstand voltage thereof, and each capacitor's capacitance per unit volume. That is to say, as the dielectric films get thinner, the withstand voltage decreases, whereas the capacitance per unit volume increases. In the case where polyesters are used as the dielectric films, the followings are found to be preferable thickness of the dielectric films.

Figure 9:
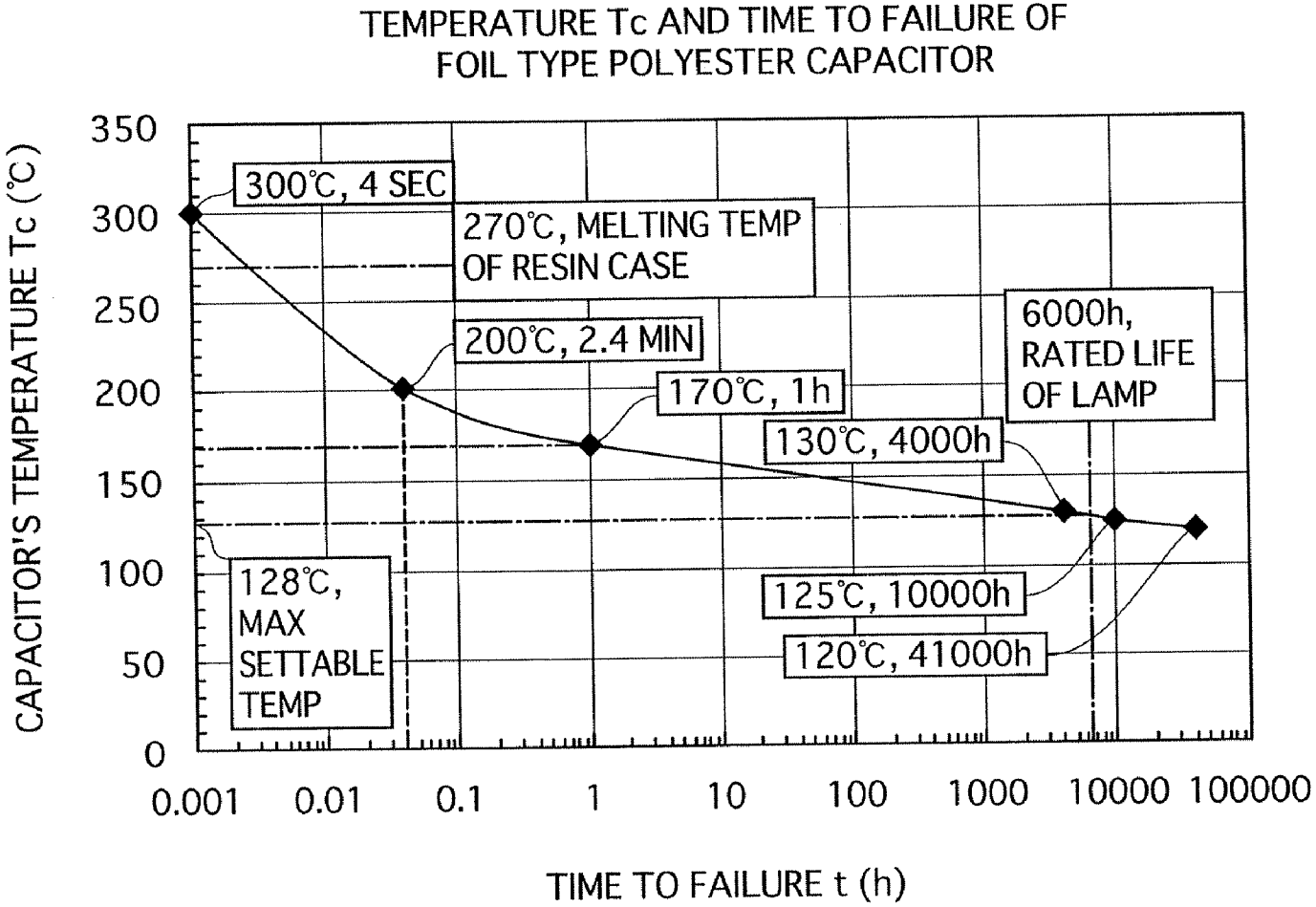
FIG. 9 shows a relation between temperature and time to failure of a capacitor.

(i) Rated voltage of DC400 V or DC250 V: 5-11 μm; (ii) rated voltage of DC1 kV or DC1.2 kV: 9-15 μm; (iii) rated voltage DC1.5 kV: 12-18 μm. In this case, the withstand voltage of the dielectric films declines depending on a temperature of the in-use capacitors. So long as the temperature of the in-use capacitors is 125° C. or less, the dielectric films function as capacitors during a given rated life. Here, as shown in FIG. 9, each capacitor's time to failure and temperature can be logarithmically related to one another, in accordance with type and processing condition of the dielectric films. Accordingly, it is possible to generate capacitors that, for example, short out in about an hour at a temperature of 170° C., or in a few minutes at a temperature of 200° C. If heat-resistant polyester films are used as the dielectric films, the rated temperature can be set to 150° C. with the same failing temperatures stated above. Furthermore, it is also allowed to use polypropylene films as the dielectric films to set the rated temperature to 85° C., so that the capacitors operate at a lower temperature.

4. Circuit Operation of Lighting Unit 50 when Arc Tube 10 is at End of Life

The following describes the circuit operation of the lighting unit 50, when the arc tube 10 is at the end of life.

When the arc tube 10 is at the end of life, an emission mix applied to electrodes runs out. Due to this and other phenomena, a voltage of the arc tube 10 increases. As a light flux is reduced, there also develops a difficulty in lighting the arc tube, causing the arc tube to flicker and flash. In this occurrence, because of the increase of the arc tube voltage, the circuit of the lighting unit 50 has a stronger resonance than that during a normal lighting operation. In other words, a resonant circuit current increases to a large extent, leading to an increase of the current flowing through the capacitors C5, C8, C6, C7, CD1 and CD2 and yielding a greater loss of electric power. As a result, these capacitors become prone to not only damage but also failure due to a temperature increase.

Moreover, the circuit of the lighting unit 50 subsequently starts to behave in an abnormal manner by continuously restarting the lighting operation immediately after an arc tube discharge goes out.

When the lighting operation starts, the inverter circuit 110 outputs a starting current into the resonant circuit 120. Being a series resonant circuit, the resonant circuit 120 lowers an impedance of the starting current. Accordingly, the starting current is three to four times larger than a lighting current that flows during the normal lighting operation. After receiving the starting current, the resonant circuit 120 applies a sparkover voltage to the filament coils attached to the arc tube 10. The sparkover voltage is about five to ten times stronger than the voltage applied during the normal lighting operation.

In the above abnormal condition, the continual repetition of the operation for starting the light may lead to the failure of the circuit components comprising the lighting unit 50. It is highly possible that such failure occurs especially to the coupling capacitors C5 and C8 through which the starting current flows, and to the resonant capacitor C6 to which the sparkover voltage is applied. However, according to the structure of the present embodiment, should the coupling capacitors C5 and C8 or the resonant capacitor C6 fail, these capacitors do not generate heat and thus prevent the discoloration and deformation of the resin case 30. This is because these capacitors fail in the complete short circuit mode.

When failing at a temperature of about 200° C. (melting point of solder) or less, the circuit components other than the above film capacitors (e.g., the transistors Q1 and Q2, choke coil L, the electrolytic capacitors CD1 and CD2) and a wiring pattern on the printed circuit board do not generate heat. This is because these components and the wiring pattern fail in the complete short circuit mode (2 ohms or less) or in the complete open circuit mode (a few hundred kilohms or more).

5. Examination Result

FIG. 4 shows an examination result of heat generated by each capacitor stored in the lamp 1 of the present invention.

With the lighting unit 50 being stored in the resin case 30, the inventors measured a surface temperature of each capacitor while the lamp 1 was supplied with the electric power. This measurement was conducted both when each capacitor functioned normally (normal capacitors), and when each capacitor was failed mandatorily (failed capacitors). First, to measure the temperature, an insertion hole was created on a sidewall of the resin case 30. Then a thermocouple was inserted through the insertion hole, so a probe tip of the thermocouple could be stuck onto an outer surface of each capacitor. The inventors created the failed capacitors by applying overvoltage and overcurrent to the capacitors using a pressure test equipment (AC voltage), high-voltage power supply, and pulse generator.

The normal coupling capacitor C5 had an external surface temperature of 100° C., while the failed coupling capacitor C5 had the external surface temperature that was the same as ambient temperature. There are two assumed reasons why the external surface temperature of the normal coupling capacitor C5 reached 100° C. One is that the normal coupling capacitor C5 generates heat by having the load current flow inside thereof during the normal lighting operation. The other is that the heat generated by other components, such as the arc tube 10, affects the surface temperature of the normal coupling capacitor C5. In fact, the temperature of the arc tube 10 hits about 200° C. during the normal lighting operation.

There are two assumed reasons why the external surface temperature of the failed coupling capacitor C5 was the same as ambient temperature. One is that the failed coupling capacitor C5 has the complete short circuit mode thus does not generate heat. The other is that the other components do not generate heat, either, as the circuit of the lighting unit 50 is terminated instantly once the coupling capacitor C5 fails. With the lighting unit 50 being terminated, the light of the arc tube goes off.

The coupling capacitor C8 has the same examination result as that of the coupling capacitor C5.

A surface temperature of the resonant capacitor C6 was 110° C. when normal, and 75° C. when failed. There are two assumed reasons why the surface temperature of the normal resonant capacitor C6 reached 110° C. One is that the resonant capacitor C6 generates heat by having a filament current flow inside thereof. The other is that the heat generated by the other components affects the surface temperature of the normal resonant capacitor C6.

It is assumed that the surface temperature of the failed resonant capacitor C6 hit 75° C. because the filament current heated the filament coils. The failed resonant capacitor C6 has the complete short circuit mode, thus does not generate heat. When the resonant capacitor C6 is failed, the voltage between the filament coils is reduced, turning off the light of the arc tube. Afterward, a continual flow of the filament current cuts off the filament, which terminates the circuit operation of the lighting unit 50.

In comparison to the foil type film capacitors, FIG. 4 also provides data when the coupling capacitors C5 and C8 are evaporated film capacitors. The evaporated film capacitors have a low resistance value, which exceeds a short circuit resistance value, and which is thus unstable. This is because the evaporated film capacitors repeat an inherent self-repairing process, which generates a discharge energy that melts and carbonizes the dielectric films. Therefore, the failed evaporated film capacitors generated heat by having the electric current flowing therethrough. According to the table of FIG. 4, when the coupling capacitors C5 and C8 are the evaporated film capacitors, the surface temperature thereof was 100° C. when normal, and over 400° C. when failed mandatorily.

It is considered that the surface temperature of the failed coupling capacitors C5 and C8 exceeded 400° C., because the failed coupling capacitors C5 and C8 generated heat triggered by the electric current flowing therethrough. The examination of the evaporated film capacitors was conducted using a thermal fuse, of which one end was connected to an input path of the rectifier smoothing circuit, while the other end was stuck onto the coupling capacitors C5 and C8 in the lighting unit. This construction caused the thermal fuse to melt while the surface temperature of the evaporated film capacitors increased, and consequently terminated the circuit operation of the lighting unit. At this point, the surface temperature of the evaporated film capacitors marked 400° C.; without the thermal fuse, the surface temperature of the evaporated film capacitors would have risen further.

The above examination finds that the foil type film capacitors do not generate heat when failed, and thus prevent the discoloration and deformation of the resin case.

As there is no need to take the heat generation into account, each capacitor can be placed in proximity to an inner wall of the resin case 30 when the lighting unit 50 is stored in the resin case 30. In FIG. 1, for instance, the coupling capacitors C5 and C8 and the resonant capacitor C6 are placed in proximity to the inner wall of the resin case 30. Owing to such a construction, it is unnecessary to enlarge an overall size of the lamp 1. In addition, as a cost to generate the foil type film capacitors is low compared to that to generate the evaporated film capacitors, a total cost for generating the lamp 1 can be accordingly reduced.

There is an occasion where the heat generated by the other circuit components lowers the withstand voltage of the dielectric films of the snubber capacitor C4; this triggers a dielectric breakdown and eventually puts the snubber capacitor C4 into failure. Similarly in this case, because the snubber capacitor C4 does not generate heat as described above, the discoloration and deformation of the resin case 30 can be prevented. If the snubber capacitor C4 shorts out, the transistor Q2 receives overvoltage and overcurrent and consequently ends up in the failure mode, terminating the lighting unit 50.

Likewise, there is an occasion where the heat generated by the other circuit components lowers the withstand voltage of the dielectric films of the auxiliary capacitor C7. In such an occurrence, as is the case with the snubber capacitor C4, the discoloration and deformation of the resin case 30 can be prevented.

The present embodiment employs the half bridge inverter. In this configuration, the two coupling capacitors C5 and C8 (included in the half-bridge inverter circuit), the filter coil NF, and the electrolytic capacitors CD1 and CD2, altogether construct the pi-shaped LC filter. In other words, the coupling capacitors C5 and C8 not only have an inherent capacitance coupling function, but also work as the noise suppression capacitors. The normally required noise suppression capacitors, which are provided at the AC power supply side, can be thus removed. Whether one should use the coupling capacitors as the noise suppression capacitors depends on whether the lighting unit 50 meets provisions of the Electrical Appliance and Material Safety Law.

Under the Japanese Electrical Appliance and Material Safety Law, a noise terminal voltage of the lighting unit 50 is specified to be 56 dBμV or less (526.5 kHz-5 MHz). In a measurement conducted by the inventors, the noise terminal voltage of the lighting unit 50 marked 44 dBμV (606 kHz) and 41 dBμV (597 kHz). The lighting unit 50, therefore, meets the provisions of the Electrical Appliance and Material Safety Law, and it is permissible to remove the noise suppression capacitors.

The foregoing has described the lighting unit and the lamp of the present invention based on the embodiment. However, the present invention should not be limited to the embodiment, but can be realized in the following modification examples.

(1) The snubber capacitor C4, which is the foil type film capacitor in the embodiment, may be a ceramic capacitor. Once the snubber capacitor C4 is failed due to the dielectric breakdown, the transistor Q2 instantly receives a large electric current flowing therethrough and ends up in failure, causing the current fuse element P2 to melt instantly. Or, once the snubber capacitor C4 is failed, if the electric current is not strong enough to cause the current fuse element P2 to melt, the transistor Q2 is turned off without being in failure. In consequence, the transistor Q1 is turned on, removing the voltage applied to the snubber capacitor C4. Eventually the snubber capacitor C4 has no more electricity once applied thereto, and recovers the withstand voltage (note that the snubber capacitor C4 has the complete open circuit mode thus has almost no capacitance). The snubber capacitor C4 does not generate heat afterward.

When the ceramic capacitor is used as the snubber capacitor C4 as previously described, the snubber capacitor C4 generates less heat. In such an occurrence, although the transistors Q1 and Q2 yield more power loss in some degree, the normal lighting operation is maintained nearly until the transistors Q1 and Q2 short out due to heat-triggered deterioration. Such a construction can safely terminate the circuit in the end. Furthermore, the use of the ceramic capacitor as the snubber capacitor can downsize the lamp. (Note that when a metallized film capacitor is used, a resistance component of the snubber capacitor C4 remains deteriorated in an unstable condition without recovering the withstand voltage, resulting in a generation of abnormal heat.)

(2) According to the embodiment, the starting capacitor C3 is the foil type film capacitor. However, being connected in parallel to the trigger diode (Diac) during the normal lighting operation, the starting capacitor C3 does not receive a voltage larger than a trigger voltage of the trigger diode (which exists in various voltages, such as: 25, 27, 32, 35, 38, 42, 48 V). When in failure, all the starting capacitor C3 receives is the voltage of less than 50 V and the electric current of 10 mA or less. It is therefore considered that the starting capacitor C3 does not generate heat that is powerful enough to discolor and deform the resin case. Accordingly, a capacitor other than the foil type film capacitor can be used as the starting capacitor C3. With a capacitor that is smaller than the foil type film capacitor, the lamp as a whole can be downsized. This leads to a conclusion that, when in failure, the capacitors and other circuit components that are applied with the voltage of less than 50 V do not generate enough amount of heat to discolor and deform the resin case in the lighting unit. In addition, the capacitors can be easily generated in good quality and at low cost. Hence, in the lighting unit that receives energy from a battery or a DC power supply, the use of the foil type film capacitors is unnecessary but acceptable, even if the capacitors are applied with a large amount of low-pressure electric power.

(3) Although the circuit structure described in the embodiment includes the auxiliary capacitor C7, the circuit structure can be constructed without the auxiliary capacitor C7. When the auxiliary capacitor C7 is excluded from the circuit structure, the preheating circuit 130 only includes a resistor element of positive temperature coefficient PTC. Yet, the resistor element of positive temperature coefficient PTC may be excluded from the preheating circuit 130 as well.

(4) According to the embodiment, the lighting circuit employs the half-bridge inverter. However, the circuit structure is not limited to such but may employ a series inverter. With the series inverter, it is necessary to additionally place the noise suppression capacitor in the lighting circuit, either on the AC power supply side, or next to a filter that follows the rectifier smoothing circuit. This is because the coupling capacitors included in the inverter circuit cannot be expected to efficiently function as the noise suppression capacitors. The circuit structure may also employ an inverter with one main switch element, a push-pull inverter, or an inverter that restrains higher harmonics.

Figure 5:
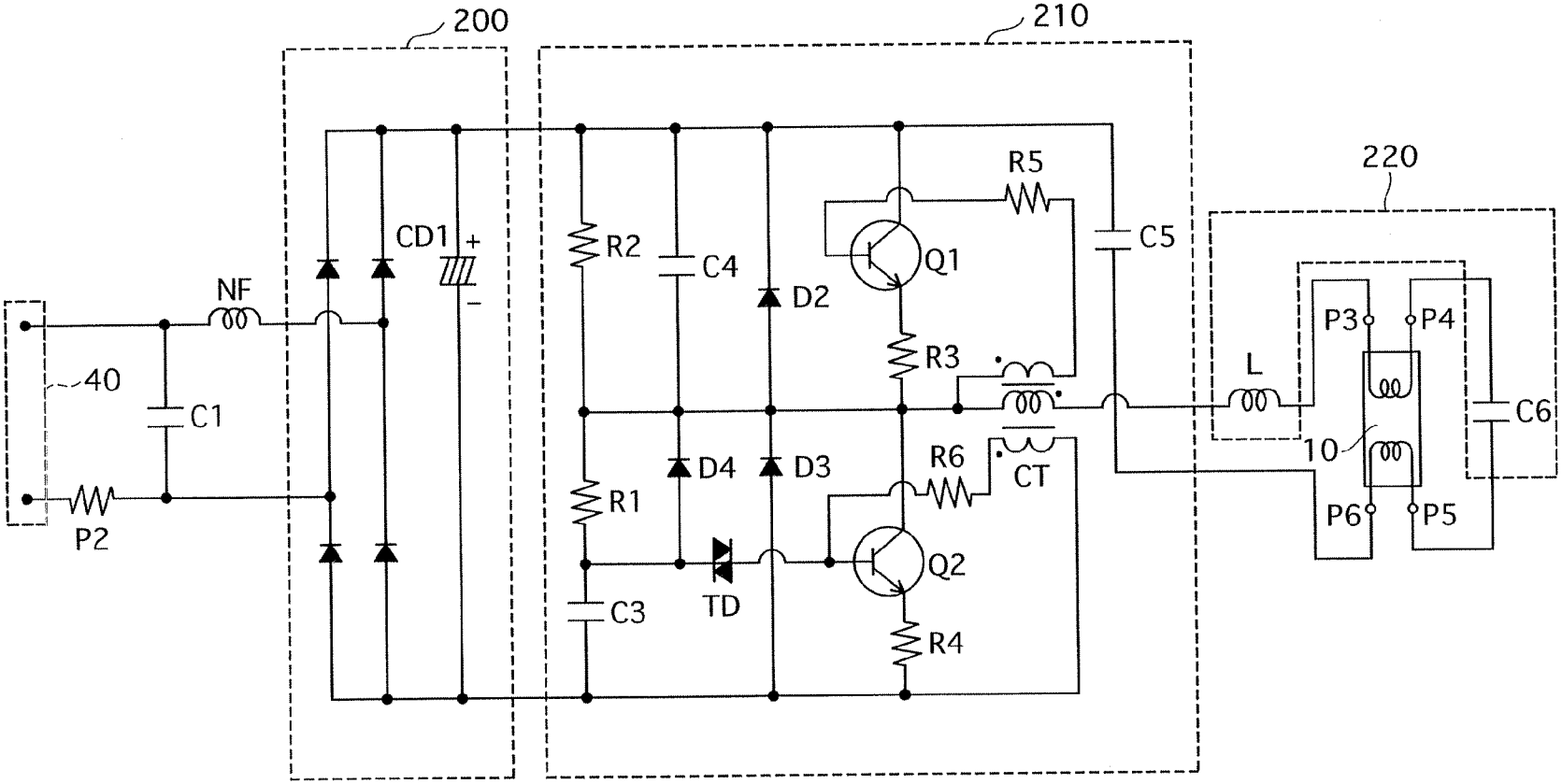
FIG. 5 shows a circuit structure of the lamp 1 relating to a modification example.

FIG. 5 shows a circuit structure of the lamp 1 according to a modification example.

The lighting unit 50 employs the series inverter.

A noise suppression capacitor C1 is connected in parallel to a rectifier smoothing circuit 200 between the resistor P2 and the rectifier smoothing circuit 200. It is desirable to use the foil type film capacitor for the noise suppression capacitor C1.

With the above configuration, the noise suppression capacitor, even when failed, does not generate heat. The discoloration and deformation of the resin case 30 can be thus prevented. Furthermore, as the noise suppression capacitor has the complete short circuit mode, once the noise suppression capacitor fails, the resistor P2 which functions as a fuse melts instantly. This meltdown can terminate the circuit operation of the lighting unit 50 on the spot. Note that the resistor P2 is preferably a wirewound resistor with a power rating ranging between ¼ W and 1 W, and between ½ ohm and 22 ohms. Here, when subjected to a voltage about 16 times larger than a regular voltage applied, the current fuse element P2 only needs to be in the complete open circuit mode within a predetermined timeframe. It is hence not necessary for the current fuse element to have specific fusing characteristics against a small current. This enables the mere wirewound resistor to prevent the discoloration and deformation of the resin case for sure, realizing the cost reduction and product downsizing.

When including the noise suppression capacitor which is the foil type film capacitor and which is placed at the AC power supply side, the circuit structure is advantageous not only for the compact fluorescent light bulb, but also for a lamp that has a light source and a lighting unit uncombined.

(5) All the capacitors described in the embodiment are the foil type film capacitors. However, the generation of heat can be prevented without the foil type film capacitors, so long as the following configuration is taken.

FIG. 6 shows a ceramic chip capacitor to which a heat protection film is attached by an adhesive.

Figure 6A:
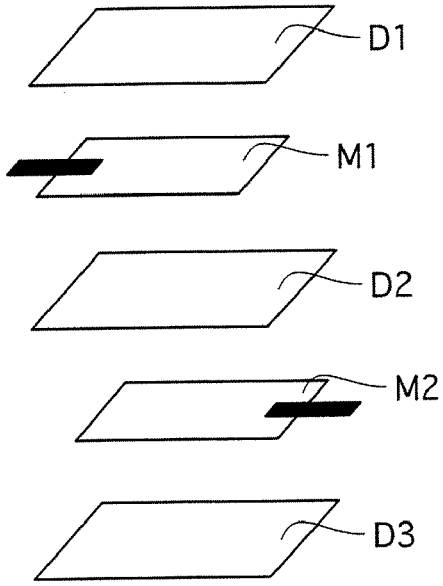
FIG. 6 shows a ceramic chip capacitor to which a heat protection film is attached by an adhesive.
Figure 6B:
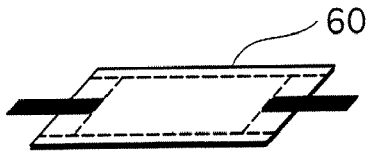
Figure 6C:
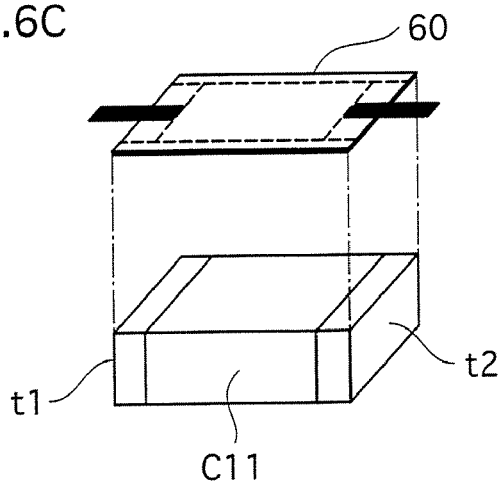

A heat protection film 60 is generated by layering polyester films D1, D2 and D3 and metal foils M1 and M2 (FIG. 6A), and pasting these together into one single sheet (FIG. 6B). With the metal foils M1 and M2 each attached with a lead, the heat protection film 60 functions as the foil type film capacitor. The polyester films undergo heat contraction over a short period of time at a temperature ranging from 130° C. to 270° C. This heat contraction lowers a withstand voltage of the heat protection film 60, which consequently shorts out.

Figure 6D:
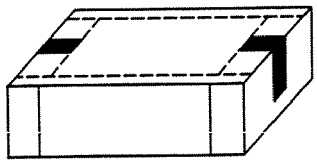

A ceramic chip capacitor C11 includes the heat protection film 60 attached by an adhesive to an outer surface thereof (FIG. 6C), wherein the leads of the heat protection film 60 are connected to terminals t1 and t2 of the ceramic chip capacitor C11 (FIG. 6D). That is to say, the heat protection film 60, which functions as the foil type film capacitor, is connected in parallel to the ceramic chip capacitor 11.

According to the above construction, if the ceramic chip capacitor C11 fails and generates heat, the generated heat short-circuits the heat protection film 60. This deters the electric current from flowing through the ceramic chip capacitor C11. As a result, the ceramic chip capacitor C11 does not generate heat after the short-circuiting of the heat protection film 60. As previously mentioned, the polyester films undergo the heat contraction at the temperature ranging from 130° C. to 270° C.; in fact, this temperature range is lower than a melting temperature of the resin case 30. Therefore, with the above ceramic chip capacitor C11 included in the lighting unit 50, it is possible to terminate the circuit operation before the resin case 30 starts to discolor or deform, or to lower an input power to perform the lighting operation in a safe condition.

Even when provided in a smaller size, the heat protection film 60 yields the similar advantages and has the same level of efficiency. Also, as shown in FIG. 6, if the heat protection film 60 is attached by the adhesive to the ceramic chip capacitor C11 beforehand, there will be no increase in man hours during the manufacturing process of the lighting unit 50. Furthermore, instead of connecting the leads to the heat protection film, the metal foils (electrodes) of the heat protection film 60 may be extended, so that the extended metal foils can be connected to the electrodes of the ceramic capacitor. This construction allows the ceramic capacitor to be easily generated.

Being able to eliminate the heat generation and unstable operation of the failed capacitors and ceramic components, the present construction does not need to load the capacitors and ceramic components with excessive performance. The present construction allows the lighting unit 50 to use small components, and thus to be small in size. Induced by a creeping discharge due to moisture and other reasons, an edge of the heat protection film has a tendency to deteriorate in the withstand voltage. Considering such a tendency, it is acceptable to fold the edge (film part) of the heat protection film, or to wrap the entire capacitor with the heat protection film several fold.

The above advantages can be obtained not only when the heat protection film is used with the ceramic chip capacitor, but also when it is used with other capacitors, such as the evaporated film capacitor.

FIG. 7 shows an evaporated film capacitor covered by the heat protection film.

Figure 7A:
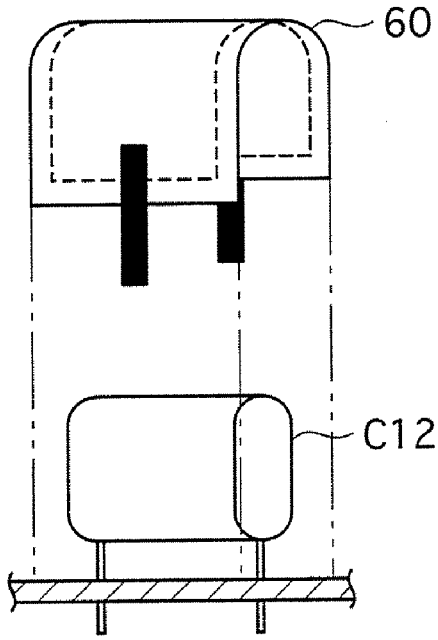
FIG. 7 shows an evaporated film capacitor covered by the heat protection film.
Figure 7B:
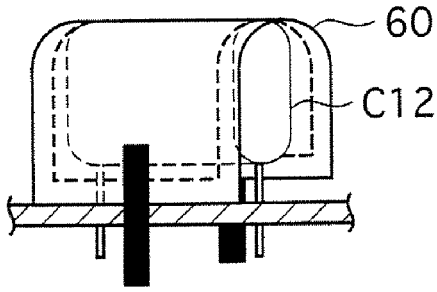

An outer periphery of an evaporated film capacitor C12 is covered by the heat protection film 60 (FIG. 7A). Leads of the evaporated film capacitor C12 are connected to the leads of the heat protection film 60 on the printed circuit board (FIG. 7B). Here, the heat protection film 60 is formed in a U-shape to fit the outer periphery of the evaporated film capacitor C12.

If the evaporated film capacitor C12 fails and generates heat in the above construction, the generated heat short-circuits the heat protection film 60. This prevents the electric current from flowing through the evaporated film capacitor C12, which consequently does not generate heat after the short-circuiting of the heat protection film 60.

With the heat protection film 60 covering the evaporated film capacitor C12, the following advantages can be further obtained: (i) an exterior of the evaporated film capacitor C12 gains an even electric intensity, regardless of a deficiency of the evaporated film capacitor C12; and (ii) a disturbance in a noise radiation pattern is reduced.

The heat protection film 60 yields the same advantages as the foil type film capacitor does. Being sheet-shaped, the heat protection film 60 can (i) cover the evaporated film capacitor C12 as shown in FIG. 7, (ii) short out completely when the evaporated film capacitor C12 generates heat, and (iii) cover only unstable, thermal-sprayed electrodes. In sum, the sheet-shaped heat protection film 60 can completely short-circuit, and at the same time, downsize the capacitor.

At first, an evaporated film capacitor develops a defect in an arbitrary, minuscule spot thereof, before the defect starts to spread with heat. According to the present embodiment, the heat generated at the minuscule spot can easily short-circuit the heat protection film, whose heat capacity is far smaller than that of the terminal fuse. That is, the heat protection film is advantaged over the thermal fuse in having a faster reaction time and smaller heat capacity, and therefore improves the safety of the circuit.

The same advantages can be obtained when the heat protection film is (i) directly connected to the leads or electrodes of the capacitors, and/or (ii) placed inside a resin coated surface, which is for enhancing a moisture resistance of the capacitors and other purposes. In the former configuration, a process of mounting components is easily conducted. In the latter configuration, the heat protection film and the capacitor, if combined together, gain an enhanced moisture resistance.

The heat protection film may be placed inside the evaporated film of the capacitor. In such a configuration, although the generated heat radiates toward outside of the capacitor to some extent, the capacitor can be downsized.

According to FIG. 7, the heat protection film covers the evaporated film capacitor. However, the heat protection film does not need to conform to such construction, but may instead cover other circuit components.

Figure 8:
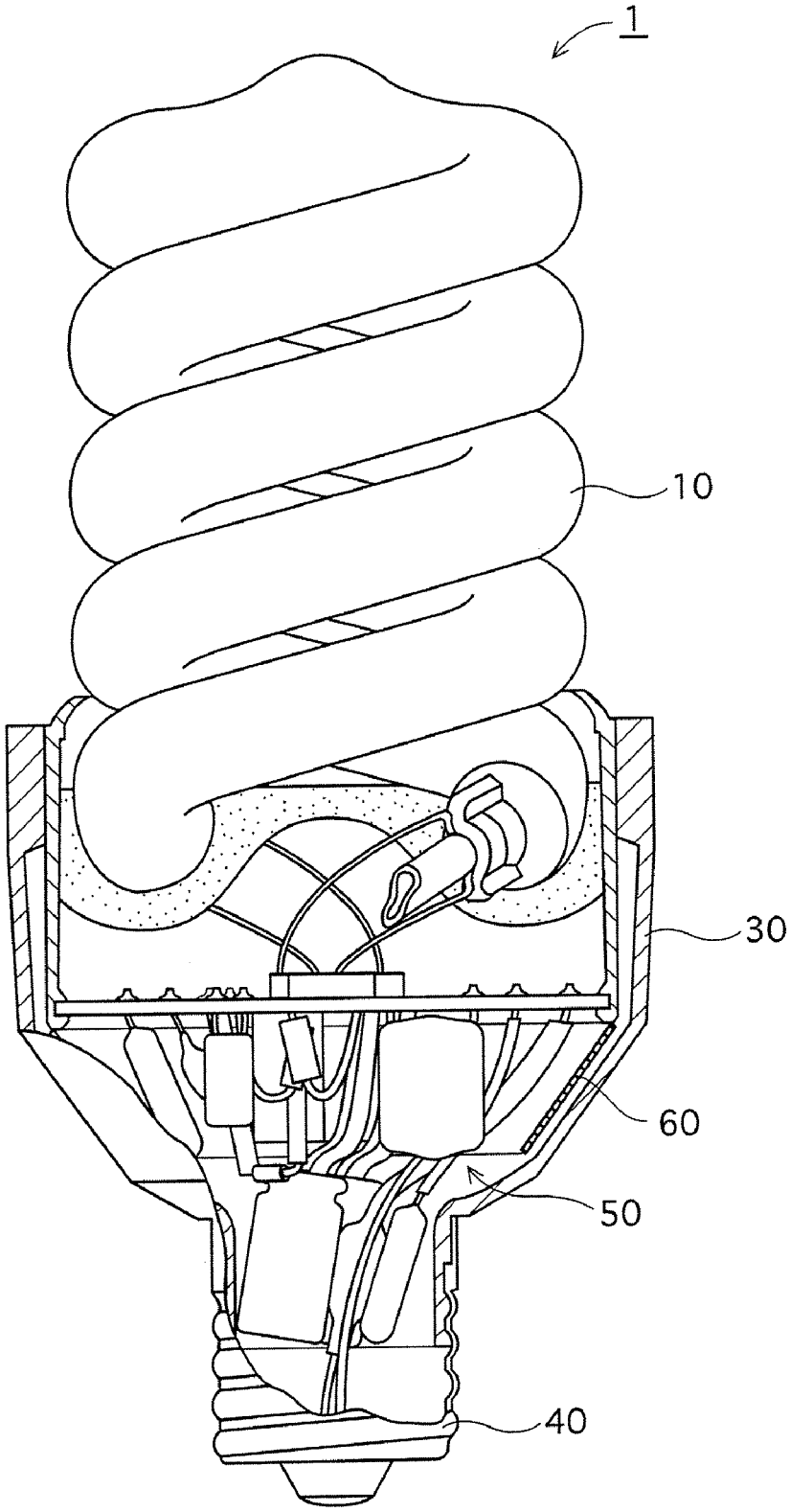
FIG. 8 is a side view of the lamp 1 relating to a modification example.

FIG. 8 is a side view of the lamp 1 according to a modification example, wherein a part of the lamp 1 is cut out to make an inside of the lamp visible.

The lamp 1 shown in FIG. 8 is different from that shown in FIG. 6 in including the heat protection film 60, which is placed to overlay the inner wall of the resin case 30. The leads of the protection film 60 are connected to the right of the resistor P2 (the arc tube side of the lighting circuit) in FIG. 3. The leads of the protection film 60 are, at the same time, connected in parallel to the AC power supply or output terminals of the rectifier smoothing circuit. In this configuration, if the heat generated by the circuit components of the lighting unit 50 is conducted to the resin case 30, the heat protection film 60 shorts out before the resin case 30 starts to deform. This triggers the meltdown of the resistor P2 and terminates the circuit operation. Here, an electric potential of the heat protection film is connected to the AC power supply, or to a constant DC electric potential that has passed through the rectification/smoothing circuit. Such a construction reduces the noise to a greater extent by shielding a noise electromagnetic field, and thereby is effective when applied to an electrodeless discharge light source, or a chopper circuit that interrupts an LED with a high frequency wave.

The heat protection film 60 yields the same advantages as the foil type film capacitors do. Having the sheet-shaped body and small heat capacity, the heat protection film 60 can be easily enlarged to protect a larger area, and has a fast reaction time without generating any delay. Furthermore, the heat protection film 60 can be readily fit into the shape of the resin case 30, and never fails to cover the entire area to protect. Many compact fluorescent light bulbs use a resin case that has a shape of a circular cone. The heat protection film 60 is compatible with such a shape, so long as the heat protection film 60 is rectangular in shape and is laid on and along the inner wall of the resin case. In another case, the capacitors themselves may be the heat protection films. With such a construction, the circuit can include fewer capacitors therein, and therefore can be downsized. When the capacitors in the inverter circuit are partially comprised of the heat protection film, a high frequency voltage is applied to the heat protection film. In this case, the noise can be further reduced by controlling two electromagnetic fields, one generated by the heat protection film and the other by the inverter.

(6) Although the above embodiment takes the low-pressure mercury discharge lamp as an example, the present invention can be applied to other types of lamps, such as an LED lamp, a halogen lamp, and an HID lamp.

INDUSTRIAL APPLICABILITY

The present invention is applicable to a lighting unit and a lamp, each operable to prevent a discoloration and deformation of a resin case even if capacitors fail.

The invention claimed is:

1. A lamp comprising:

a light source;

a lighting unit that lights the light source with an inverter while receiving electric power from an AC power supply, and that contains a printed circuit board and a plurality of circuit components inclusive of capacitors, the printed circuit board being populated with the circuit components; and a case for holding the light source and storing the lighting unit, wherein among the capacitors, all capacitors with an applied voltage of 50V or greater are foil type film capacitors with an exception of a smoothing electrolytic capacitor, and the foil type film capacitors are placed along a periphery of the printed circuit board.

2. The lamp of claim 1, wherein the lighting unit includes two switch elements and two coupling capacitors, both of which (i) are connected in series to an output terminal of a rectifier smoothing circuit, and (ii) together constitute a half-bridge inverter circuit, and at least one of the two coupling capacitors is placed in an area that is the farthest from the light source stored in the case.

3. The lamp of claim 1, wherein the light source is a low-pressure mercury discharge tube.

4. The lamp of claim 3, wherein the low-pressure mercury discharge tube, from one end to the other thereof, is formed into a double spiral.

5. A lamp comprising:

a light source;

a lighting unit that lights the light source with an inverter while receiving electric power from an AC power supply, and that contains a printed circuit board and a plurality of circuit components inclusive of capacitors, the printed circuit board being populated with the circuit components; and a case for holding the light source and storing the lighting unit, wherein among the capacitors, all capacitors with an applied voltage of 50V or greater are foil type film capacitors with exceptions of a smoothing electrolytic capacitor and a ceramic snubber capacitor, and the foil type film capacitors are placed along a periphery of the printed circuit board.

6. The lamp of claim 5, wherein the light source is a low-pressure mercury discharge tube.

7. The lamp of claim 5, wherein the lighting unit includes two switch elements and two coupling capacitors, both of which (i) are connected in series to an output terminal of a rectifier smoothing circuit, and (ii) together constitute a half-bridge inverter circuit, and at least one of the two coupling capacitors is placed in an area that is the farthest from the light source stored in the case.

* * * * *

UNITED STATES PATENT AND TRADEMARK OFFICE

CERTIFICATE OF CORRECTION

PATENT NO. : 7,692,369 B2
APPLICATION NO. : 11/577699
DATED : April 6, 2010
INVENTOR(S) : Morimoto et al.

It is certified that error appears in the above-identified patent and that said Letters Patent is hereby corrected as shown below:

On the Title Page:
Item (86) PCT No.: PCT/JP2006/003946 should read --PCT/JP2006/303946--.

Signed and Sealed this

Fifteenth Day of June, 2010

David J. Kappos

David J. Kappos
*Director of the United States Patent and Trademark Office*